US005127444A

United States Patent [19]

Takano et al.

[11] Patent Number: 5,127,444

[45] Date of Patent: Jul. 7, 1992

[54] METHOD AND APPARATUS FOR LENO WEAVING A THREE DIMENSIONAL FABRIC

[75] Inventors: Yuushiro Takano, Sagamihara; Tsutomu Kikuchi, Kawagoe; Makoto Tanaka, Fukui, all of Japan

[73] Assignee: Tominaga Machine Mfg. Co., Ltd., Fukui, Japan

[21] Appl. No.: 661,530

[22] Filed: Feb. 26, 1991

[30] Foreign Application Priority Data

Feb. 28, 1990 [JP] Japan ..... 2-50205
Jul. 4, 1990 [JP] Japan ..... 2-178315

[51] Int. Cl.[5] ..... D03D 19/00; D03D 11/00; D03C 7/00

[52] U.S. Cl. ..... 139/52; 139/20; 139/408

[58] Field of Search ..... 139/50, 51, 52, 411

[56] References Cited

U.S. PATENT DOCUMENTS 2,033,800 3/1936 Wood ..... 139/52
3,818,951 6/1974 Greenwood .
4,368,760 1/1983 Frommert .

FOREIGN PATENT DOCUMENTS 95144 12/1897 Fed. Rep. of Germany .
2706298 8/1978 Fed. Rep. of Germany .
2707705 8/1978 Fed. Rep. of Germany .
3818680 10/1989 Fed. Rep. of Germany ..... 139/50
2171009 9/1973 France .
57-00480 2/1982 Japan ..... 139/51
61-1538 1/1986 Japan .

*Primary Examiner*—Andrew M. Falik
*Attorney, Agent, or Firm*—Marshall, O'Toole, Gerstein, Murray and Bicknell

[57] ABSTRACT

A weaving method and a leno heald system for producing a 3-dimensional woven fabric which includes a plurality of stacked single-ply webs ($A_1$, $A_2$, $A_3$, $A_4$) each comprising a weft yarn (2) which cross-bridges between warp yarns (1) arranged in rows in each web. The adjacent webs are connected together by a second warp yarn (3) which either cross-links to one of the warp yarns (1) at a cross-linking location or to the weft yarn adjacent the cross-linking location. The successive cross-linking locations are spaced in the weaving direction by at least one weft yarn course.

3 Claims, 10 Drawing Sheets

FIG. 5

| COURSE | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| HEALDS 10 | | | | | | | | | | | | | | |
| $10_R$ | UP | DOWN | UP | DOWN | UP | DOWN | UP | DOWN | UP | DOWN | UP | DOWN | UP | DOWN |
| $10_C$ | DOWN | UP | DOWN | UP | DOWN | UP | DOWN | UP | DOWN | UP | DOWN | UP | DOWN | UP |
| $10_L$ | UP | DOWN | UP | DOWN | UP | DOWN | UP | DOWN | UP | DOWN | UP | DOWN | UP | DOWN |
| LIFTING HEALDS 12 | | | | | | | | | | | | | | |
| $12_R$ (SHED) | CENTER<br>– | CENTER<br>– | UP<br>(UP) | UP<br>(UP) | CENTER<br>– | CENTER<br>– | DOWN<br>(DOWN) | –<br>– | –<br>– | –<br>– | –<br>– | –<br>– | –<br>– | –<br>– |
| $12_L$ (SHED) | –<br>– | –<br>– | –<br>– | –<br>– | –<br>– | –<br>– | –<br>– | CENTER<br>– | CENTER<br>– | UP<br>(UP) | UP<br>(UP) | CENTER<br>– | CENTER<br>– | DOWN<br>(DOWN) |
| $12_R$ (SHED) | –<br>– | –<br>– | –<br>– | –<br>– | –<br>– | –<br>– | –<br>– | –<br>– | CENTER<br>– | CENTER<br>– | UP<br>(UP) | UP<br>(UP) | CENTER<br>– | CENTER<br>– |
| $12_L$ (SHED) | DOWN<br>(UP) | CENTER<br>– | CENTER<br>– | UP<br>(UP) | UP<br>(UP) | CENTER<br>– | CENTER<br>– | DOWN<br>(DOWN) | –<br>– | –<br>– | –<br>– | –<br>– | –<br>– | –<br>– |

METHOD AND APPARATUS FOR LENO WEAVING A THREE DIMENSIONAL FABRIC

BACKGROUND OF THE INVENTION

This invention relates to: a three-dimensional woven fabric which is comprised of warp yarns, weft yarns, and a second-warp yarns for cross-linking opposing web plies, and which is useful as a structural reinforcement material; together with the method for weaving that fabric and the apparatus specifically needed to accomplish that weaving method.

Various patent applications have been made in the past relating to three-dimensional woven fabrics for industrial use and the methods for weaving them. Representative of these three-dimensional woven fabrics for industrial use are three-dimensional woven fabrics woven so that the warp yarns, the weft yarns, and the vertical-direction yarns, which are arranged at right angles to each other, are all cross-ridged with respect to one of those sets of yarn. In addition, as a method for weaving that type of three-dimensional woven fabric, a method (Japanese Patent Publication (S)61-1538) has been proposed in which the carrier arm of the bobbin carrier which revolves around one of the said warp, weft, and vertical-direction yarns holds the bobbins which contain the other two component yarns, and an operation is repeated in which, by the revolution of said carrier arm, those bobbins are successively transferred to the carrier arms of the adjacent bobbin carriers, and said bobbins containing those other two component yarns are moved in different perpendicular directions.

However, with the three-dimensional woven fabric described above, the construction of said three-dimensionally woven fabric was not such that it was possible to freely increase the coarseness of the structural gaps (freely form spaces or gaps within the structure) of the fabric. Therefore, when using the woven fabric having this type of construction as a foundation for industrial use, for example, as a reinforcement foundation (reinforcement material) for the cement of a concrete structure, or as a reinforcement foundation for the composite members of an aircraft, space station, etc., it was not possible to supply the amount of cement, resin, etc., into the woven structure needed to achieve the intended function, thus posing problems for use as a reinforcement material.

In addition, although the three-dimensional woven fabrics such as that described above are woven using methods such as that disclosed in the aforementioned Publication (S)61-1538, with the prior art methods such as this, because the bobbins containing the two component yarns described above would interfere with each other if they were simultaneously moved in perpendicularly intersecting directions, it is not possible to move the bobbins simultaneously. Thus, when weaving a three-dimensional woven fabric using this type of method, because each of the bobbins must be moved successively at different times in the corresponding intersecting directions, one weaving cycle (for example, one cycle in which the weft yarns and the warp yarns are woven just once with respect to the vertical-direction yarns) requires as much time as a few minutes, thus presenting the drawback of making commercial mass production difficult.

Furthermore, with the weaving method described above, because of the nature of the method, it was not possible to beat up the weft yarns tightly against the warp yarns using a reed, and as a result, only fabrics in which the density of the web constructed of the warp yarns and the weft yarns was relatively low could be woven, and the weaving method was not adequate in cases where a high density web was required.

In consideration of the conditions described above, the objective of this invention is to propose: a three-dimensional woven fabric for which it possible to freely form spaces of any desired size within the woven structure of the three-dimensional woven fabric, which can be efficiently woven, and which also has a construction in which it is possible to increase the density as needed; together with the method for weaving said three-dimensional woven fabric and the apparatus specifically needed to accomplish that weaving method.

SUMMARY OF THE INVENTION

The three-dimensional woven fabric of this invention is characterized in that the weft yarns cross-bridge between the warp yarns which are arranged in rows in each level of a multi-level configuration so that each level weaves a one-ply web, and, in addition, each of said one-ply webs, which are positioned opposite each other vertically, are joined together by the cross-linking of second-warp yarns either to one of said warp yarns at the location to be cross-linked or to the weft yarn courses located on either side of the location to be cross-linked, and the joining locations of these second-warp yarns shift each time at least one weft yarn course in the weaving direction.

In addition, the weaving method for the three-dimensional woven fabric of this invention is characterized in that groups of warp yarns comprised of multiple warp yarns are arranged in a multi-level configuration an appropriate number of the warp yarns of these groups of warp yarns in each of said levels alternately open to form a shed, and the weft yarns are inserted into these opened parts so that they cross these warp yarns. In addition, in order for each of the webs comprised of said level-like adjacent groups of warp yarns and the weft yarns which are inserted therein to be joined together using cross-linking second-warp yarns, at the time of the insertion of said weft yarns, at the location to be cross-linked, each of the cross-linking second-warp yarns which are arranged between each of said levels are either cross-linked with the warp yarns by shifting in the direction in which the weft yarns are inserted with respect to the warp yarn being cross-linked, or they are cross-linked with the weft yarns by moving at the opening of the shed to the opposite side with respect to the preceding course so that they shift with respect to the weft yarn being cross-linked.

In addition, the special leno heald system for weaving a multi-ply web of this invention which is specifically needed to accomplish the weaving method described above is characterized in that:

it is equipped with lifting healds positioned on each side and with leno healds which are positioned between those lifting healds so that they engage with one of the lifting healds in accompaniment to that lifting heald's lifting motion and ascend and descend while moving closer to that lifting heald, and which also have a passage hole at their upper ends for the passage of the second-warp yarn;

said lifting healds on each side are formed of a pair of right and left parallely arranged rod-shaped members, and, in addition, each is equipped with multiple vertically positioned right-left pairs of guides which are provided with engagement means for the support of the leno healds;

the top of said upper end of each leno heald is shaped so that it slopes downward toward said lifting healds positioned on each side, and each said leno heald is provided with slide parts which extend downward from each side of said upper end along said lifing healds and which are longer in length than the ascent/descent stroke of that leno heald;

the leno healds are arranged in multiple levels so that each of the slide parts on each side of said leno healds is supported by the engagement means of the lifting heald located on that side and guided during the ascent and descent motion.

BRIEF DESCRIPTION OF THE DRAWINGS

FIG. 5 is a table showing the operation conditions of the healds and the lifting healds during weaving.

DESCRIPTION OF THE PREFERRED EMBODIMENTS

The following is a detailed explanation of an embodiment of this invention based on the accompanying drawings.

Figure 1:
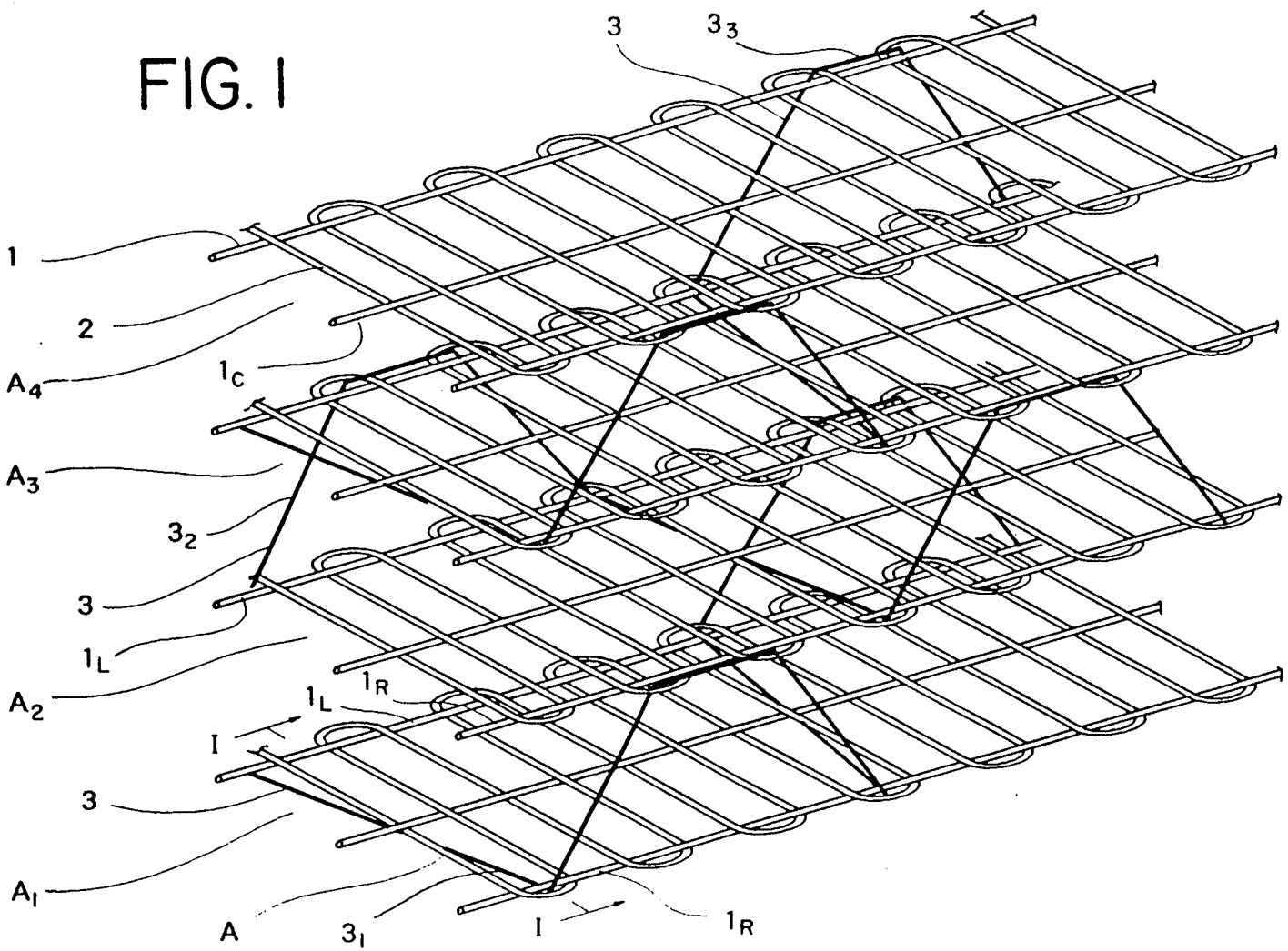
FIG. 1 is a perspective view showing the structure of the three-dimensional woven fabric of this embodiment of the invention.
Figure 2:
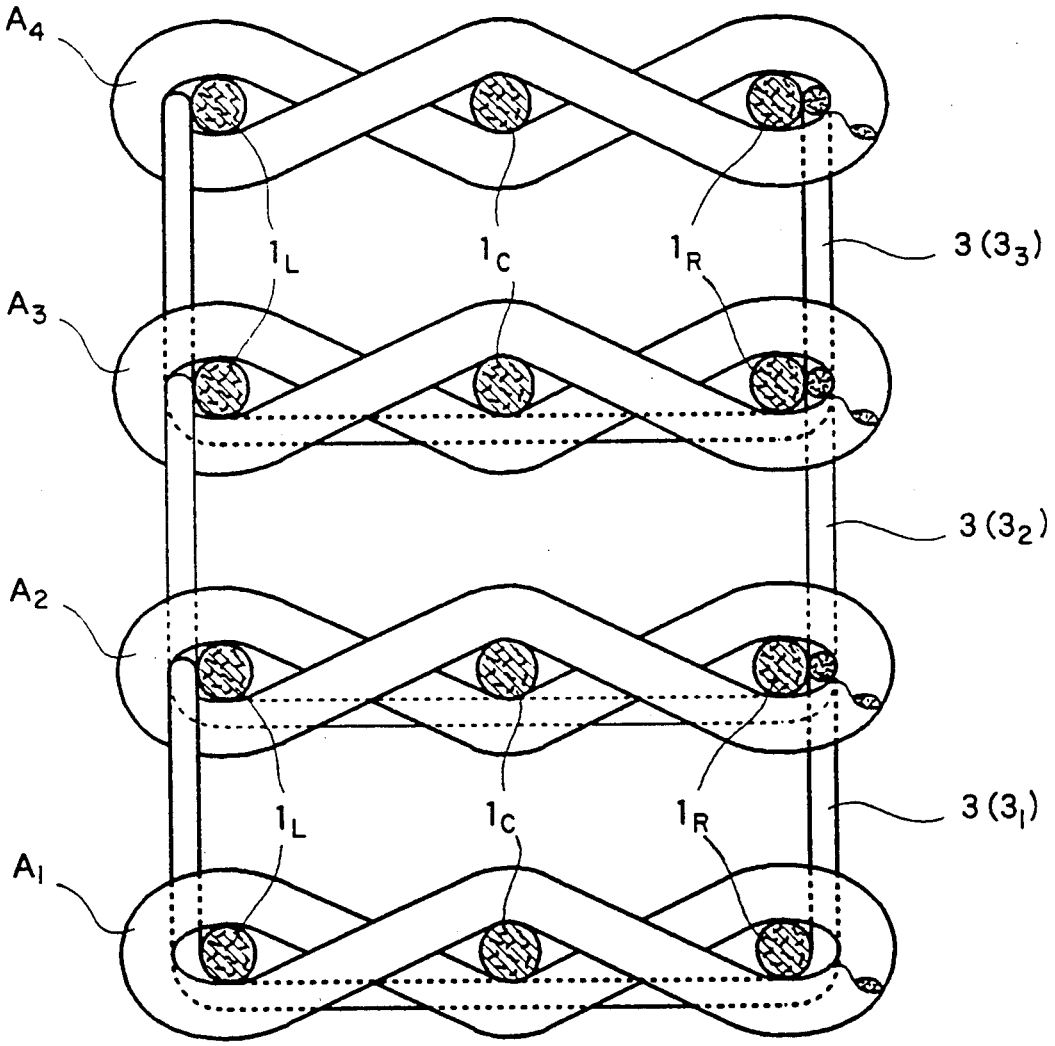
FIG. 2 is a cross-sectional view along plane I—I in FIG. 1 showing the structure of the three-dimensional woven fabric.

First, in FIG. 1, 1 indicates the warp yarns, 2 indicates the weft yarns, and 3 indicates the second-warp yarns for cross-linking opposing web plies. In this embodiment, in order to make it easier to understand, the explanation will use as an example the simplest three-dimensional woven fabric of this invention. In other words, a one-ply web A is woven by the cross-ridging of the weft yarns 2 with respect to groups of warp yarns each comprised of three warp yarns 1, and multiple plies (multiple levels; in this embodiment, four plies $A_1 \sim A_4$) of this web A are positioned opposite each other vertically. One second-warp yarn 3 (although one yarn is used in this embodiment, it is also possible to have multiple second-warp yarns, and multiple second-warp yarns would normally be used for an actual threedimensional woven fabric) for joining together each of the adjacent plies of the webs A which are positioned opposite each other vertically (ply $A_1$ and ply $A_2$, ply $A_2$ and ply $A_3$, ply $A_3$ and ply $A_4$) shifts at the location to be cross-linked in the direction in which the weft yarns are inserted with respect to the warp yarns 1, and the second-warp yarn 3 is cross-linked with the warp yarn 1, thus accomplishing the joining at that location. In addition, in a different mode of joining which is also used, the second-warp yarn 3 moves at the opening of the shed in the opposite direction from the preceding course at the location to be cross-linked, and, when the weft yarn is inserted into this opening in this condition, the second-warp yarn 3 shifts and becomes cross-linked with the weft yarn 2, thus accomplishing the joining at that location.

The second-warp yarn 3 which joins together two vertically opposing webs A (for example, web $A_1$ and web $A_2$) is cross-linked at the location of any arbitrary warp yarns 1, in this embodiment, warp yarns $\mathbf{1}_R$ and $\mathbf{1}_L$ on each side, of the groups of warp yarns in one of the webs A (for example, web $A_1$), and it is also cross-linked at the location of any arbitrary warp yarns 1, in this embodiment, warp yarns $\mathbf{1}_R$ and $\mathbf{1}_L$ on each side, of the groups of warp yarns in the other vertically opposing webs A (for example, web $A_2$), thus joining together the two webs A (in this case, web $A_1$ and web $A_2$). Thus, as shown in FIG. 1, the first-ply web $A_1$ and the second-ply web $A_2$, the second-ply web $A_2$ and the third-ply web $A_3$, and the third-ply web $A_3$ and the fourth-ply web $A_4$ are joined by the three second-warp yarns 3 ($\mathbf{3}_1$, $\mathbf{3}_2$, and $\mathbf{3}_3$).

Figure 3:
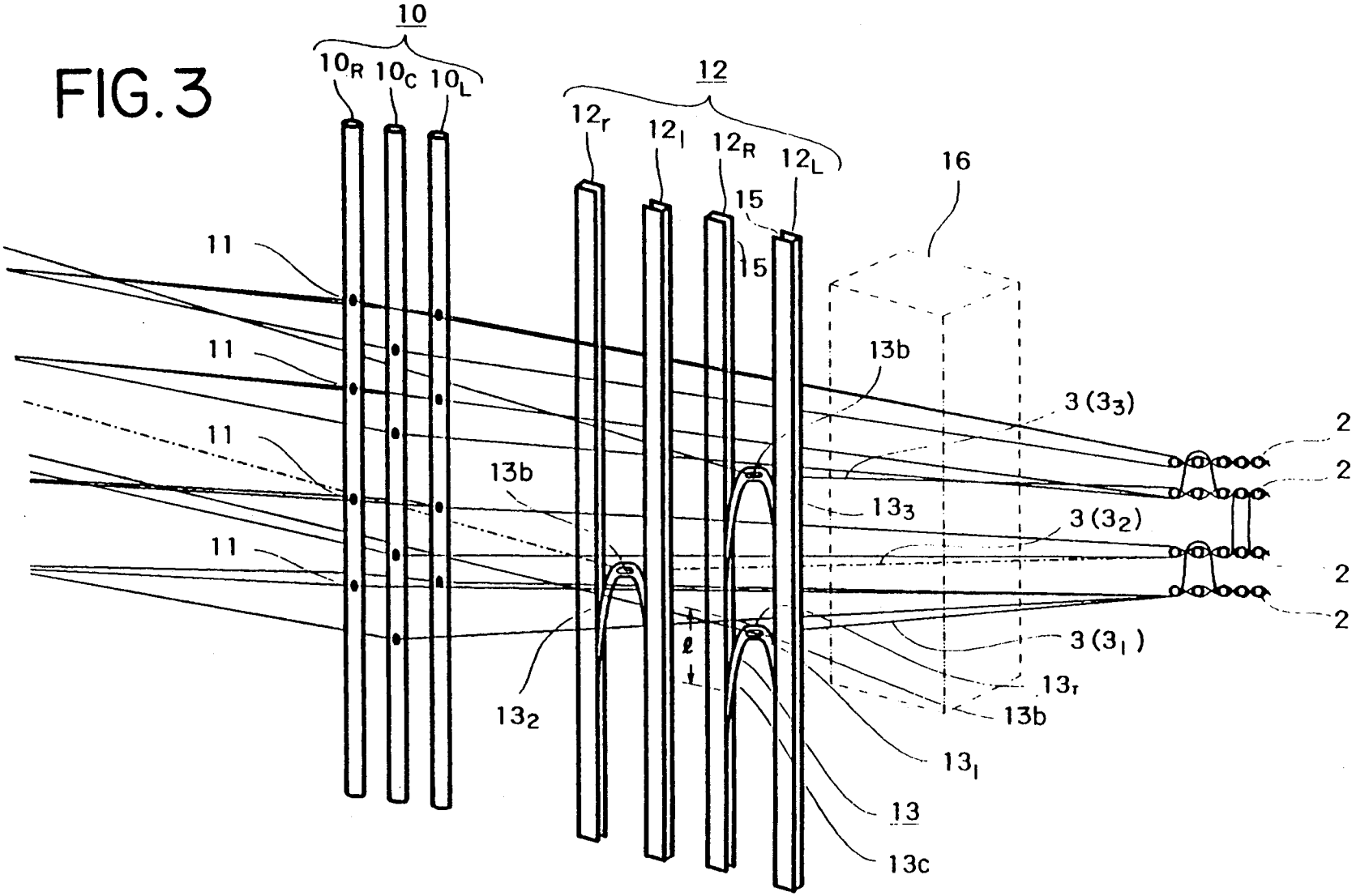
FIG. 3 is a perspective view of a model of the apparatus for manufacturing the three-dimensional woven fabric.
Figure 4:
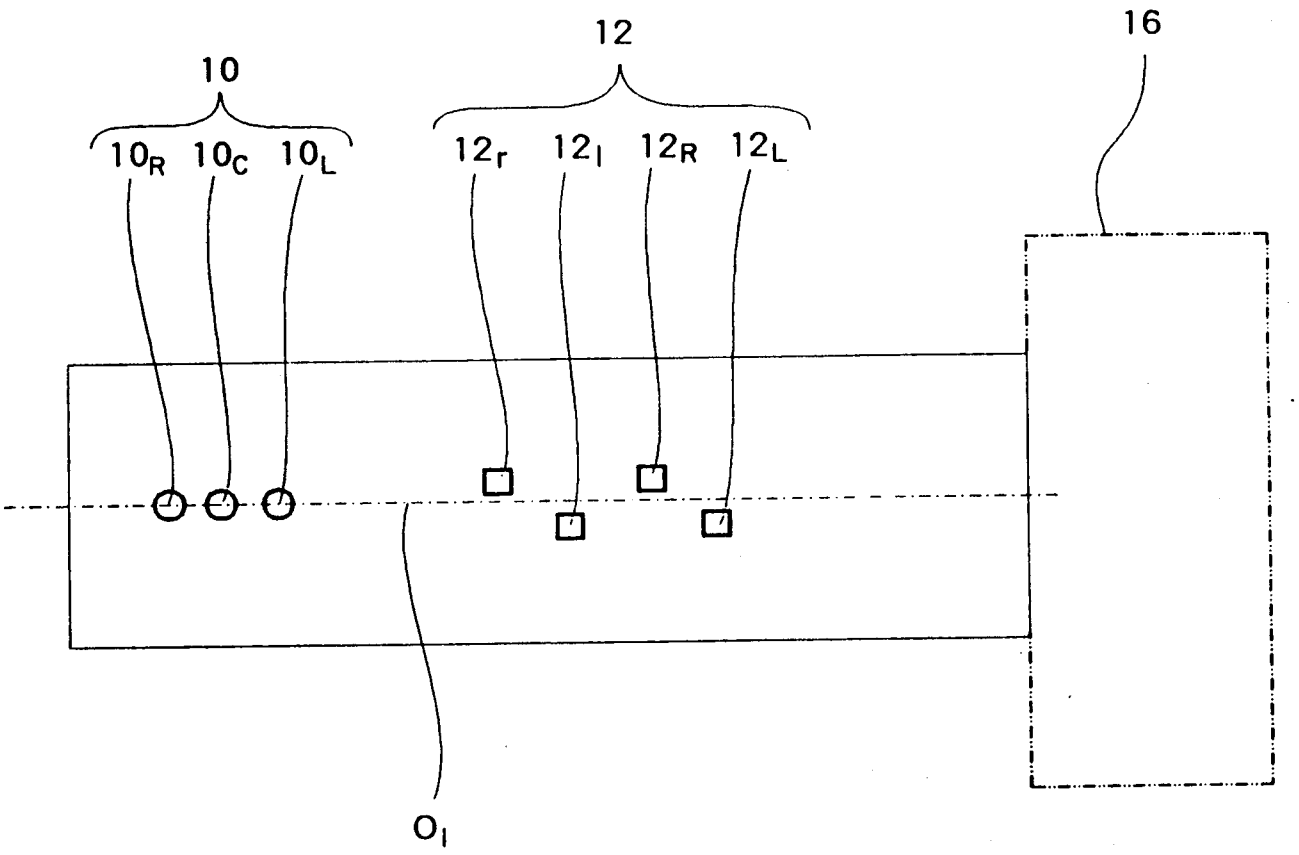
FIG. 4 is a plan layout view showing the arrangement conditions of each component of the model apparatus of FIG. 3.

Also, using the apparatus which is illustrated in model form in FIGS. 3 and 4, the three-dimensional woven fabric described above can be manufactured more efficiently than the three-dimensional woven fabrics of the prior art. The following is an explanation of that weaving method based on this apparatus.

In FIGS. 3 and 4, three healds 10 ($\mathbf{10}_R$, $\mathbf{10}_C$, and $\mathbf{10}_L$) are each arranged so that they can freely move up and down with respect to the frame. Four warp yarn passage holes 11 are formed at vertical intervals in these healds 10 in order to allow the passage of the warp yarns 1 for each level.

Also, to the rear (refers to the down-line direction in the weaving process; in FIGS. 3 and 4, the right side) of these three healds 10, lifting healds 12 ($\mathbf{12}_r$, $\mathbf{12}_l$, $\mathbf{12}_R$, and $\mathbf{12}_L$) are arranged so that they can freely move up and down with respect to the frame. The layout of the passage holes on the horizontal plane, in other words, the layout of the lifting healds 12 on the horizontal plane, is such that, in order for these lifting healds 12 and the leno healds 13 to function smoothly as a leno mechanism, as illustrated in FIG. 4, the first and second lifting healds $\mathbf{12}_r$ and $\mathbf{12}_l$, and the third and fourth lifting healds $\mathbf{12}_R$ and $\mathbf{12}_L$, are arranged on opposing sides of a line $\mathbf{0}_1$ extended from the center line along which the healds 10 are arranged. The purpose of these lifting healds 12 is to move the second-warp yarns 3 to the desired locations (in other words, of the two plies, toward any arbitrary warp yarn group or any arbitrary shed, or in the weft yarn insertion direction of any arbitrary warp yarn). In this embodiment, the lifting heald $12_L$ shifts the tips (upper ends) of the leno heald $13_1$ and the leno heald $13_3$ toward the left so that they pass to the left side of the warp yarns 1 to be passed. In addition, the lifting heald $12_R$ shifts the tips (upper ends) of the leno heald $13_1$ and the leno heald $13_3$ toward the right so that they pass to the right side of the warp yarns 1 to be passed. At the same time, the lifting heald $12_l$ shifts the tip (upper end) of the leno heald $13_2$ toward the left so that it passes to the left side of the warp yarn 1 to be passed, and the lifting heald $12_r$ shifts the tip (upper end) of the leno heald $13_2$ toward the right so it passes to the right side of the warp yarns 1 to be passed.

On each of these lifting healds $12_r$ and $12_l$, and $12_R$ and $12_L$, are formed guide grooves 15 which guide the leno healds 13 which ascend and descend in accompaniment to the ascending and descending of the corresponding opposing lifting healds 12. The leno heald $13_1$ having a second-warp yarn passage hole **13*b* which operates the second-warp yarn $3_1$ and the leno heald $13_3$ having a second-warp yarn passage hole 13*b* which operates the second-warp yarn $3_3$ are attached to the lifting healds $12_R$ and $12_L$, and the leno heald $13_2$ having a second-warp yarn passage hole 13*b* which operates the second-warp yarn $3_2$ is attached to the lifting healds $12_r$ and $12_l$. Although in this embodiment the leno heald $13_1$ and the leno heald $13_3$ are both attached to the same lifting healds $12_R$ and $12_L$ in order to weave a three-dimensional woven fabric such as that shown in FIG. 1**, if it is necessary to operate the two leno healds separately, it is also possible to attach them to different lifting healds (each to one pair of lifting healds).

The composition is such that the distance (length) l from the tip $13_T$ of the leno healds $13_1$, $13_2$, and $13_3$ to the point of contact $13_C$ with the lifting heald 12 to which each is attached or by which each guided is equivalent to the distance between the uppermost and the lowermost positions of the second-warp yarn 3 at the weaving locations (the locations at which the weft yarns are inserted), in other words, the distance between the bottom of the shed in the group of warp yarns for that level (for example, the first level) and the top of the shed in the group of warp yarns for the adjacent level (for example, the second level).

Also, to the rear of this series of lifting healds 12 is located a weft yarn guide mechanism 16 which is simplified in the drawings as a box outlined in dots and dashes. This weft yarn guide mechanism 16 can be an apparatus known in the public domain, such as shuttle loom, or if a narrower shed opening is desired, a rapier loom.

Furthermore, although not shown in the drawings, in front of the weft yarn guide mechanism 16 is positioned a reed as needed in order to increase the density of the web.

Thus, when weaving the three-dimensional woven fabric, the various warp yarns 1 are passed through the four warp yarn passage holes 11 in the corresponding healds 10. The lowermost three of these warp yarns 1 are the group of warp yarns (the group of warp yarns on the first level) which form the first-ply web $A_1$, the next three are the group of warp yarns (the group of warp yarns on the second level) which form the second-ply web $A_2$, the next three are the group of warp yarns (the group of warp yarns on the third level) which form the third-ply web $A_3$, and the uppermost three are the group of warp yarns (the group of warp yarns on the fourth level) which form the fourth-ply web $A_4$.

In addition, the various second-warp yarns 3 are passed through the second-warp yarn passage holes **13*b* in the leno healds 13. Of the second-warp yarns 3**, the bottom second-warp yarn is the second-warp yarn $3_1$ for joining the first-ply web $A_1$ and the second-ply web $A_2$, the center second-warp yarn is the second-warp yarn $3_2$ for joining the second-ply web $A_2$ and the third-ply web $A_3$, and the top second-warp yarn is the second-warp yarn $3_3$ for joining the third-ply web $A_3$ and the fourth-ply web $A_4$.

Also, for this embodiment, the weft yarn guide mechanism 16 is provided with shuttles (not shown in the drawings) for the insertion of the weft yarns 2 into the shed openings of each ply (each level).

After all of the above preparations are complete, weaving begins. In other words, for the weaving of the three-dimensional woven fabric shown in FIG. 1, sheds are opened by operating the three healds $10_R$, $10_C$, and $10_L$ so that, of these three healds $10_R$, $10_C$, and $10_L$, the two healds on the two sides are positioned on the opposite side of the shed from the one heald in the center, and, in addition, the four lifting healds $12_L$, $12_R$, $12_l$, and $12_r$, are operated appropriately so that they are shifted with respect to the warp or weft yarns at the warp yarns at the location to be cross-linked, or at the course at which the weft yarn is inserted, or at the courses preceding and following that course, and, moreover, the weft yarn guide mechanism 16 is operated at a timing synchronized with the above operation for each course so that the shuttles are operated in such a manner that they intersect the warp yarns 1 at right angles, thus making it possible to weave the web A.

Specifically, the operation conditions of the healds $10_R$, $10_C$, and $10_L$ and the lifting healds $12_L$, $12_R$, $12_l$, and $12_r$ during the weaving from the right end of FIG. 1 toward the left can be explained as follows in reference to FIG. 5, which shows those operation conditions.

At the weaving of the first course (at the insertion of the weft yarn at the right end of the web in FIG. 1), the healds $10_R$ and $10_L$ rise (indicated as "Up" in FIG. 5) relative to the heald $10_C$, and, in addition, the apparatus operates so that the second-warp yarn passage holes **13*b* of the leno healds $13_1$ and $13_3$ attached to the lifting heald $12_R$ are positioned to the right side of the corresponding warp yarns of the heald $10_L$ between the first level and the second level (midway between the two levels; indicated as "Center" in FIG. 5) and between (midway between) the third level and the fourth level, respectively, and so that second-warp yarn passage hole 13*b* of the leno heald $13_2$ attached to the lifting heald $12_l$ is positioned to the left of the warp yarn of heald $10_R$ below (expressed as "Down" in FIG. 5; above the opening would be expressed as "Up") the opening of the shed of the second level (the lower position for this leno heald; expressed in FIG. 5 as "Down"). In this state, the shuttles of the weft yarn guide mechanism 16 move so that the weft yarns 2** are inserted on each level.

Next, at the weaving of the second course, the healds $10_R$ and $10_L$ descend relative to the heald $10_C$, and, in addition, the apparatus operates so that the second-warp yarn passage holes **13*b* of the leno healds $13_1$ and $13_3$ attached to the lifting heald $12_R$ are positioned to the right side of the corresponding warp yarns of the heald $10_L$ between (midway between) the first level and the second level and between (midway between) the third level and the fourth level, respectively, and so that second-warp yarn passage hole 13***b* of the leno heald $13_2$ attached to the lifting heald $12_l$ is positioned to the left of the warp yarn of heald $10_R$ between (midway between) the second level and the third level. Then, in this state, the shuttles of the weft yarn guide mechanism 16 move so that the weft yarns 2 are inserted on each level, and the second course of each ply of the web A is woven.

In this way, by operating each of the healds $10_R$, $10_C$, and $10_L$ and the lifting healds $12_L$, $12_R$, $12_l$, and $12_r$ so that they are positioned at the positions indicated in the table in FIG. 5, it is possible to weave the three-dimensional woven fabric shown in FIG. 1.

Also, for each course during the weaving, by beating up a reed (not shown in the drawings) located in front of the weft yarn guide mechanism 16 at the desired strength as necessary, the density of the web woven in the preceding process can be increased as desired, and the desired three-dimensional woven fabric can be obtained.

Further, with the three-dimensional woven fabric woven as described above, because each ply of the web A is woven by the insertion and cross-ridging of the weft yarn 2 with respect to the groups of warp yarn 1 just as a conventional web, and because it is possible to use a reed during the progress of this weaving, that is, during the process following the insertion of the weft yarn 2, it is possible to achieve a high-density web just as for a conventional web A, and, in addition, because it is possible, by adjusting the feed amount of each of the second-warp yarns 3, to freely adjust the interval between each of the plies of the web A, it is possible to provide spaces of any desired size between each of the web plies.

Moreover, when weaving this three-dimensional woven fabric, because, as described above, the joining locations of the second-warp yarn are shifted at least one course each time in the direction of weaving, it is not necessary to stop the weaving operation of the warp and weft yarns in order to join the second-warp yarns, thus making it possible to weave the three-dimensional woven fabric having the composition described above at a speed which is many times faster than the weaving speed for the three-dimensional woven fabrics of the prior art.

Figure 11A:
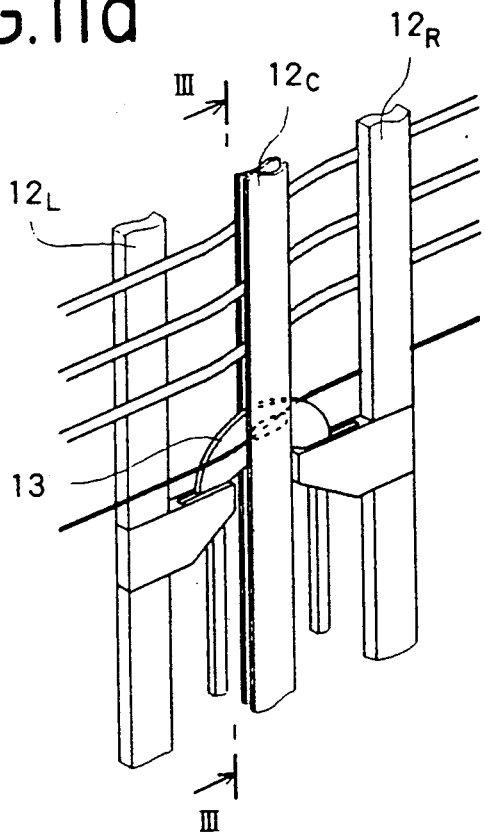
FIG. 11(*a*) is a perspective view showing the composition of the essential parts the leno heald system in yet another embodiment of the invention, FIG. 11(*b*) is a side view from the direction of arrows III—III in FIG. 11(*a*) showing the composition of the center lifting heald, and FIG. 11(*c*) is a cross-sectional view of the fabric structure woven by this leno heald system.
Figure 11B:
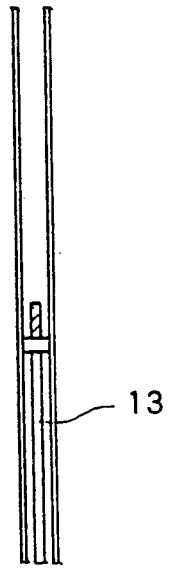
Figure 11C:
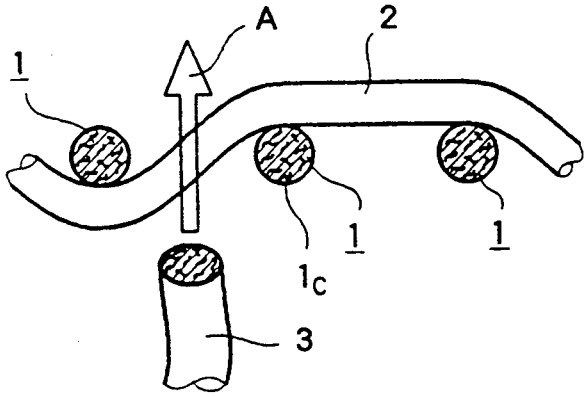

It should be noted that, in the embodiment described above, of the groups of warp yarn on each level, if it is necessary to cross-link the second-warp yarn with the warp yarns positioned in the center, it is possible to provide three lifting healds for one leno heald and then operate the center of the three lifting healds in order to cross-link the yarn. Specifically, as illustrated in FIG. 11(*c*), the insertion of the second-warp yarn 3 into the warp yarn 1 or weft yarn 2 and the cross-linking of that second-warp yarn 3 with the warp yarn 1 positioned in the center of the groups of warp yarns on each level can be accomplished by providing a lifting heald $12_C$ having a side composition such as that illustrated in FIG. 11(*b*) midway between the lifting healds $12_L$ and $12_R$ on each side as shown in FIG. 11(*a*) and then operating this center lifting heald $12_C$ so that, as illustrated in FIG. 11(*c*), the second-warp yarn 3 of the leno heald 13 moves in the direction indicated by the arrow A and is cross-linked with the center warp yarn $1_C$.

Although a model form of the special leno heald system for weaving a multi-ply web composed of lifting healds and leno healds such as that illustrated in FIG. 3 was used to explain the embodiment above in order to make it easy to understand the actual weaving method for the three-dimensional woven fabric, in actuality, the apparatus used is like that illustrated in FIG. 6 and FIGS. 8 through 10.

Figure 8C:
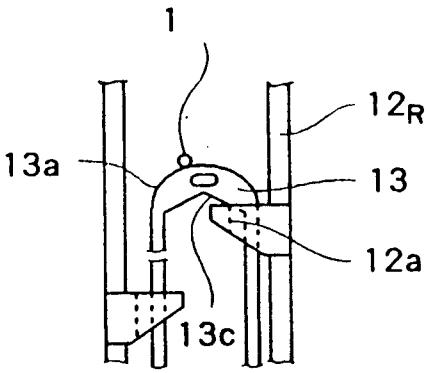
FIGS. 8(*a*) through 8(*c*) are enlarged frontal views showing the composition and operation of the engagement part of the leno heald.
Figure 8A:
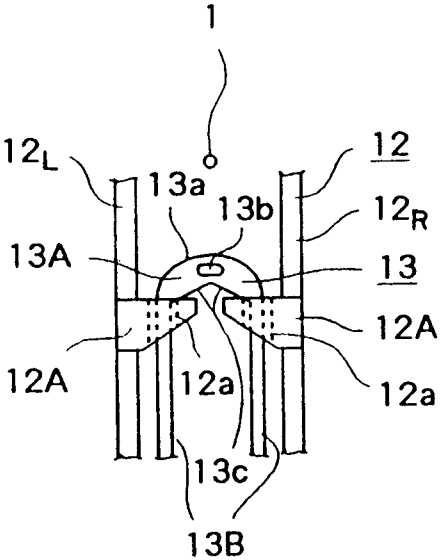
Figure 8B:
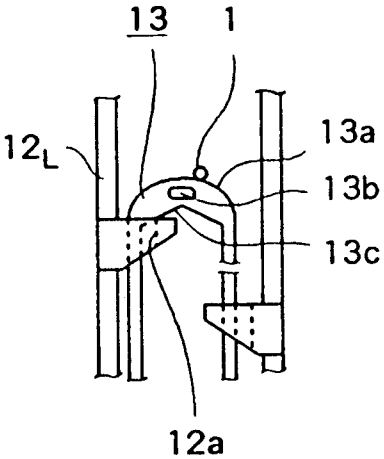

In other words, for this special leno heald system M for weaving a multi-ply web, the lifting healds 12 are composed of rod-like members (in this embodiment, flat rod-shaped members) and these rod-shaped lifting healds 12 ($12_L$ and $12_R$) are arranged in pairs left and right. On each pair of rod-shaped members multiple guide members (guide parts) 12A are arranged vertically so that they face each other. As shown in FIG. 8(*a*), for this embodiment, guide holes 12*a* which have through passages in the vertical direction and which are in the shape of elongated holes extending toward the opposing lifting heald 12 are formed in these guide members 12A as an engagement means. At locations where one leno heald 13 (the slide part 13B of the leno heald 13) is engaged (refer to the upper guide member 12A in FIG. 6(*a*)), one guide hole 12*a* is formed in the direction of the elongated hole, and in locations where two leno healds 13 are engaged (refer to the lower guide member 12A in FIG. 6(*a*)), two guide holes 12*a* are formed.

Figure 6B:
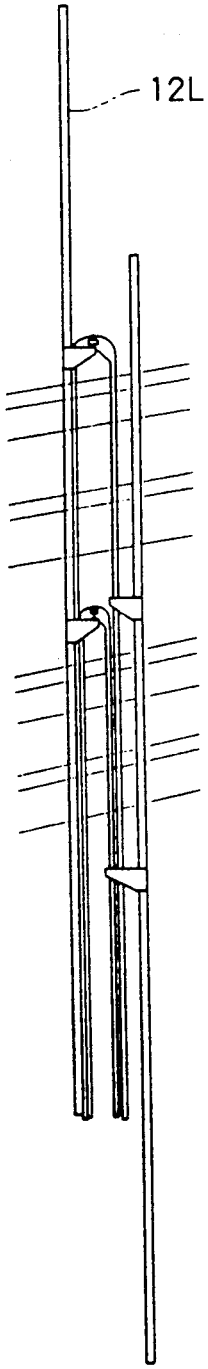
FIGS. 6(*a*) through 6(*c*) are frontal views showing the composition and operation conditions of the essential parts of a practical application of the leno heald system.
Figure 6A:
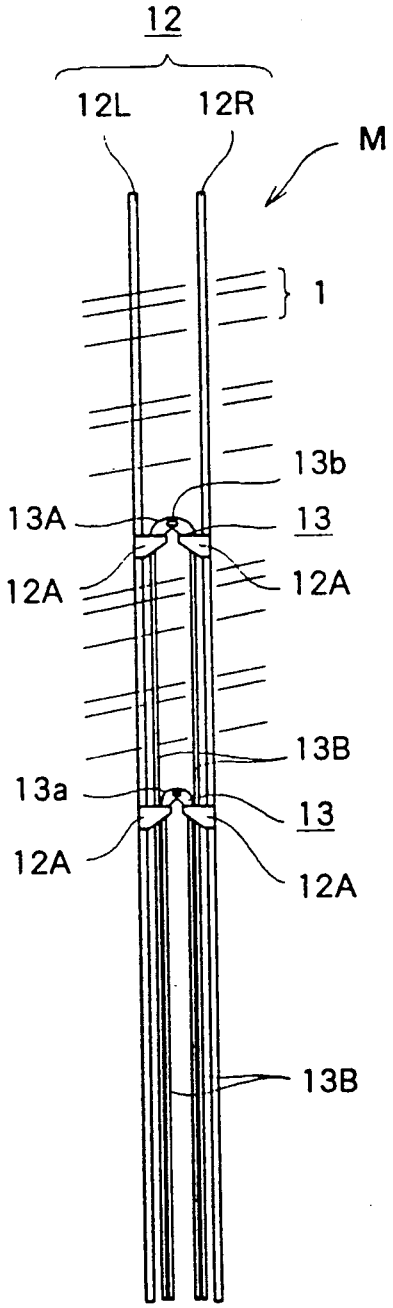
Figure 6C:
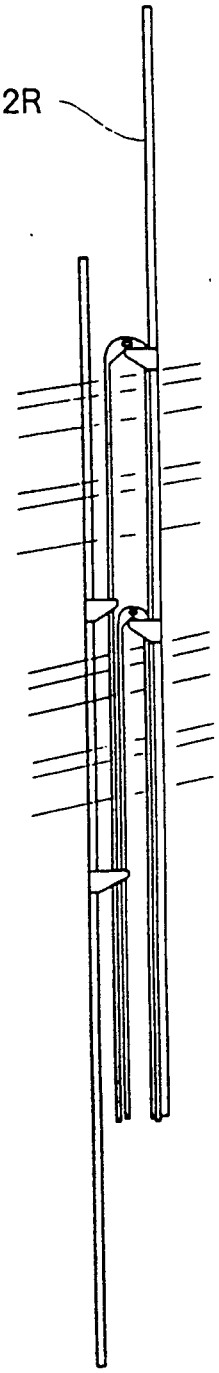

Each of these pairs of lifting healds 12 is arranged on the frame of the weaving machine in such a manner that it is possible for it to be raised from the condition in FIG. 6(*a*) to the condition shown in FIG. 6(*b*) or FIG. 6(*c*), or lowered from the condition shown FIG. 6(*b*) or FIG. 6(*c*) to the condition shown in FIG. 6(*a*) by an operating means not shown in the drawings.

Further, as shown in each of the drawings in FIG. 6 or FIG. 8, the overall approximate shape of the leno healds 13 is in the form of an upside-down U, and the top 13*a* is semicircular and formed in a shape in which both sides slant downwards from the center. In addition, a passage hole 13*b* for the passage of the second-warp yarn 3 is formed in the center area of the upper part 13A on which this top 13*a* is located, and slanted surfaces 13*c* which slant downwards toward the two sides from the center are provided on the inside bottom of this upper part 13A. In this embodiment, these slanted surfaces 13*c* slant at angle of approximately 45° with respect to the horizontal plane, and the included angle of the two slanted surfaces 13*c* is approximately 90°. Furthermore, on this leno heald 13, thin rod-shaped slide parts 13B extend downward from this upper part 13A parallel to the rod-shaped parts of the lifting healds 12. These slide parts 13B are composed so that their length is at least longer (in this embodiment, approximately three times as long as the stroke) than the ascent/descent stroke of that leno heald 13, and so that their thickness (cross section) is such that it is possible for them to be inserted into the guide holes 12*a* of the lifting healds 12 and to move freely in the lateral directions.

Thus, when one of the lifting healds 12, for example the lifting heald $12_L$ on the left side, is operated so that it moves upward, as shown in FIG. 8(*b*), the slanted surface 13*c* of the leno heald 13 comes in contact with the corner of the wall of the guide hole 12*a* of the lifting heald 12 which is closer to the leno heald 13 and the slant of the slanted surface 13*c* causes the leno heald 13 to move closer to that lifting heald $12_L$. As a result, the warp yarn 1 contacts and is guided by the slanted right side of the top 13*a* of the leno heald 13, the leno heald 13 passes on the left side of the warp yarn 1, and the second-warp yarn 3 is positioned on the left side of the warp yarn 1 one level above.

In this embodiment, as illustrated in FIG. 6(*a*), because the leno healds 13 are arranged so that a maximum of two leno healds overlap on the same plane (on the same vertical plane), there are large leno healds and small leno healds which fit inside each other within the same plane, and the small leno healds 13 are formed to a size which will fit inside the space within the U-shape of the large leno healds 13.

Figure 9:
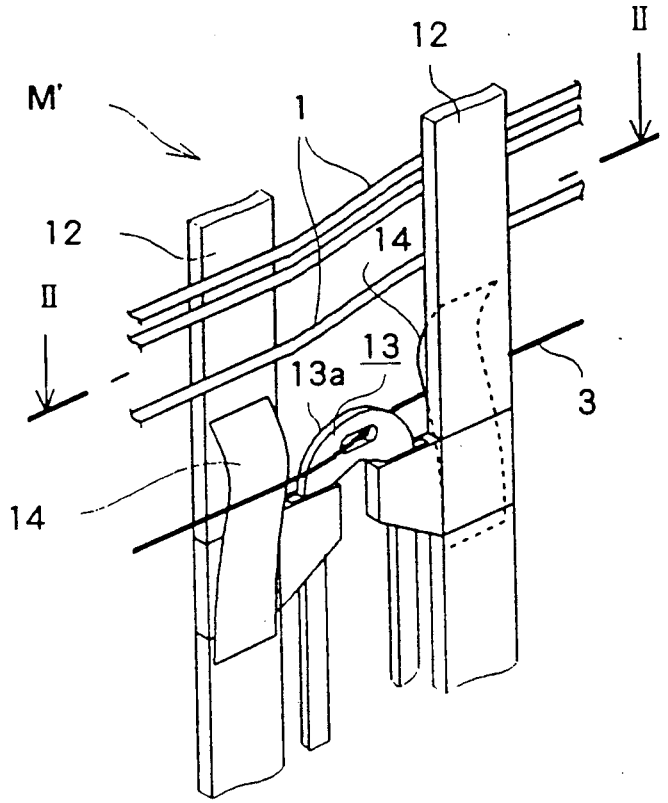
FIG. 9 is a perspective view showing the composition of the essential parts of the leno heald system in another embodiment of the invention.
Figure 10:
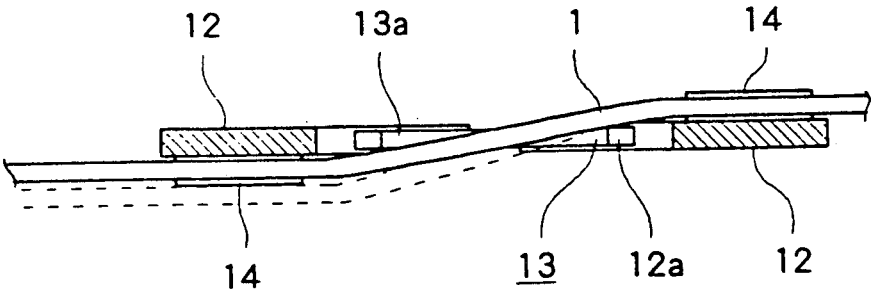
FIG. 10 is a perspective view along plane II—II in FIG. 9.

In addition, for this special leno heald system M for weaving a multi-ply web, it is preferred that, as illustrated in FIG. 9, guide plates 14 having a dog-leg shape when seen from the side be mounted on the sides of the lifting healds 12 on which the warp yarns 1 pass so that the tops of the guide plates are positioned level with or higher than the top of the leno heald 13 which is engaged at that position, and also so that the upper and lower ends of the guide plates are flush (this indicates a smoothly joined surface) with the outer surfaces of those parts of the lifting healds 12. By doing this, when the leno heald passes to the side of one of the warp yarns 1 as described above, the warp yarn 1 which might become caught on the top of the leno heald 13 is pushed to the opposite side as illustrated in FIG. 10, and a space equivalent to the thickness of that leno heald 13 is formed between that lifting heald 12 and the warp yarn 1, thus acting together with the slant of the top 13*a* of the leno heald 13 to ensure a smoother passage of the leno heald 13 (refer to FIG. 10). Thus, it is preferred that a special leno heald system M′ for weaving a multi-ply web having a composition such as this be used for actual weaving machines, especially for weaving machines which weave at high speed.

Furthermore, although in the explanation of the above embodiment the engagement means of the lifting healds is a guide hole with the shape of an elongated hole and the slide part of the leno healds is formed in a thin rod shape, in place of these, it is also possible to form the engagement means and the slide part using other known slide mechanisms.

Figures 7A, 7B, 7C:
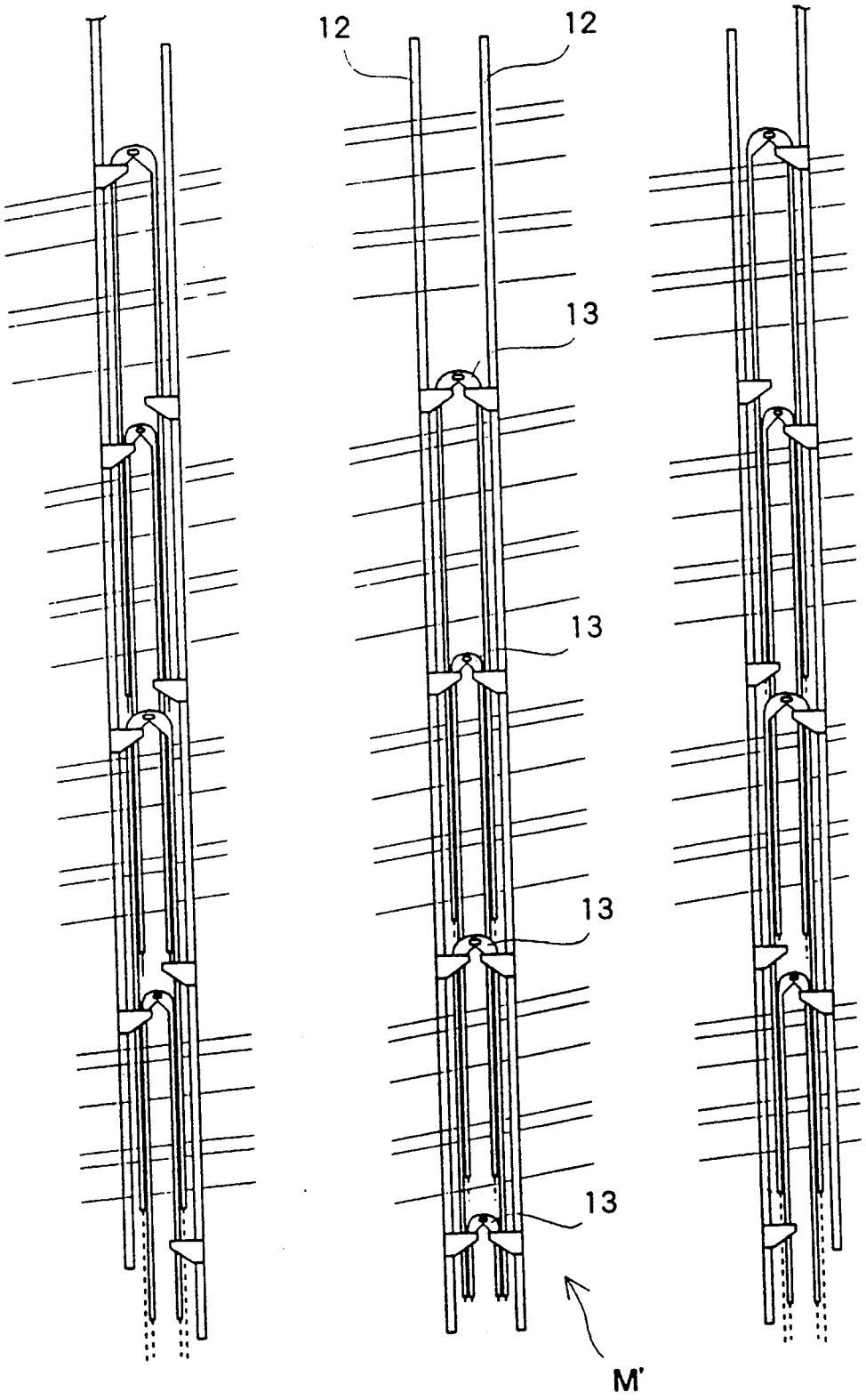
FIGS. 7(*a*) through 7(*c*) are partial frontal views showing the composition and operation conditions of the essential parts of a leno heald system for multiple plies.

In addition, in order to weave a three-dimensional woven fabric having more web plies, for example a three-dimensional woven fabric having a 10-ply web, by arranging two of the special leno heald systems M′ for weaving a multi-ply web shown in FIGS. 7(*a*) through 7(*c*) each equipped with four leno healds 13 between the lifting healds 12 at the front and rear, and operating them using the same procedure described above, it is possible to weave a three-dimensional woven fabric having a 10-ply web A.

Also, by adjusting the feed amount of the leno healds 13 during the weaving process, it is possible to achieve the desired distance between each of plies of the multi-ply web A.

In addition, although the explanation of the embodiment above related to the operation for the linking of two web plies positioned one above another by a single second-warp yarn, instead of this, it is also possible to increase the length of the slide part of the leno heald in order to link three or more web plies positioned one above another by a single second-warp yarn, and, in some cases, it is also possible to operate between the lifting healds so that a single second-warp yarn links two or more web plies while skipping one web ply located between them.

Furthermore, by arranging multiple special leno heald systems in the same initial positions at the front and rear and operating the lifting healds of these systems differently, it is also possible to link each of the web plies at multiple locations using multiple second-warp yarns.

With the three-dimensional woven fabric of this invention described above, because each of the web plies (each level) which comprise the three-dimensional woven fabric can be woven to any desired density and also because spaces of any desired size can be formed between each of the multiple web plies, it can be used as a foundation for industrial use, such as a reinforcement foundation (reinforcement material) for the cement of a concrete structure, or as a reinforcement foundation for the composite members of an aircraft, space station, etc., and when used for these purposes, in addition to a high level of strength being provided by the high weaving density of each web ply, the spaces between each of the web plies can be filled with cement, resin, etc., at ideal conditions.

In addition, with the weaving method of this invention, the three-dimensional woven fabric having the excellent weaving characteristics described above can be woven at an extremely high level of efficiency, thus making it possible to supply it in large quantities at low cost.

Furthermore, because the special leno heald system for weaving a multi-ply web of this invention can, as described above, smoothly position the second-warp yarn at any desired position and on either side of the groups of warp yarns which form the multi-level multiple web plies, it is possible to weave the useful three-dimensional woven fabric described above at an extremely high level of efficiency.

Thus, in addition to being able to supply large quantities of the three-dimensional woven fabric to the market in response to the expected increase in demand, it is also possible to supply it at a price low enough even for use in the fields of general civil engineering and construction.

We claim:

1. A weaving method for a three-dimensional woven fabric formed of weft yarns, cross-linking second-warp yarns, and groups of warp yarns, the groups of warp yarns being multiple warp yarns in multi-level configuration and warp yarns of each level forming sheds having alternate openings, and adjacent groups of said warp yarns of a level forming webs, comprising the steps of arranging said groups of warp yarns in said multi-level configuration, configuring a number of said warp yarns of said groups of warp yarns in each of said levels alternately open to form said shed, inserting said weft yarns into said openings so that they cross said warp yarns; and, in addition, in order for each of said webs and said weft yarns which are inserted therein to be joined together using said cross-linking second-warp yarns, at the time of the insertion of said weft yarns and at the location to be cross-linked, each of said cross-linking second-warp yarns which are arranged between each of said levels are either cross-linked with said warp yarns by shifting in one direction in which said weft yarns are inserted with respect to said warp yarn being cross-linked, or they are cross-linked with said weft yarns by moving at said opening of said shed to the opposite direction with respect to a preceding course so that they shift with respect to said weft yarn being cross-linked.

2. A special leno heald system having sides for weaving a multi-ply web including second-warp yarn, characterized in that: it is equipped with lifting healds positioned on each of said sides and with leno healds which are positioned between those lifting healds so that they engage with one of the lifting healds in accompaniment to that lifting heald's lifting motion and ascend and descend while moving closer to that lifting heald, and which also have a passage hole at their upper ends for the passage of said second-warp yarn;

said lifting healds on each side are formed of a pair of right and left parallely arranged rod-shaped members, and, in addition, each is equipped with multiple vertically positioned right-left pairs of guides which are provided with engagement means for the support of the leno healds;

the top of said upper end of each leno heald is shaped so that it slopes downward toward said lifting healds positioned on each side, and each said leno heald is provided with slide parts which extend downward from each side of said upper end along said lifting healds and which are longer in length than the ascent or descent stroke of that leno heald;

the leno healds are arranged in multiple levels so that each of the slide parts on each side of said leno healds is supported by the engagement means of the lifting heald located on that side and guided during the ascent and descent motion.

3. A special leno heald system as described in claim 2, and further including guide plates whose overall shape is curved in a dog-leg configuration, said guide plates being mounted at each of the engagement parts of said lifting healds on the sides on which the warp yarns pass, whereby when the leno heald is engaged in each of said engagement parts, the tops of said guide plates are positioned level with or higher than the top of the leno heald and so that the upper and lower ends of the guide plates are flush with the outer surfaces of said rod-shaped parts.

* * * * *